US005501251A

United States Patent [19]

Vader et al.

[11] Patent Number: 5,501,251

[45] Date of Patent: Mar. 26, 1996

[54] WIRE TWISTING AND CUTTING TOOL

[76] Inventors: Robert L. Vader; Michael C. Vader, both of P.O. Box 608, San Clemente, Calif. 92674

[21] Appl. No.: 360,980

[22] Filed: Dec. 20, 1994

[51] Int. Cl.[6] ..... B21F 15/04

[52] U.S. Cl. ..... 140/53; 140/57; 140/119

[58] Field of Search ..... 140/53, 54, 57, 140/93 A, 118, 119

[56] References Cited

U.S. PATENT DOCUMENTS

| | | | |
|---|---|---|---|
| 861,915 | 7/1907 | Struss | 140/53 |
| 1,209,434 | 12/1916 | Hayden | 140/119 |
| 3,091,264 | 5/1963 | Stanford . | |
| 3,593,759 | 7/1971 | Wooge . | |
| 4,448,225 | 5/1984 | Schmidt . | |

*Primary Examiner*—Lowell A. Larson

[57] ABSTRACT

A frame containing a wire supply coil and a clamping and cutting shears actuated by toggle links connecting the arms of the shears to the frame. The pivot of the shears is attached to one end of a piston, the other end of which slides in a cylinder in the frame. A compression spring between the piston and cylinder tends to bias the piston away from the frame thereby applying a wire clamping force to the jaws of the shears through the action of the toggle links. A drag strut is provided to oppose the biasing force and open the jaws of the shears. The rotating shaft of a commercially available rachet spring return twister is attached to the frame. This twister converts a linear pulling motion into rotary motion thereby twisting the wire and making the fastener. Further pulling on the twister shears the wires.

5 Claims, 2 Drawing Sheets

WIRE TWISTING AND CUTTING TOOL

BACKGROUND—FIELD OF INVENTION

This invention relates to a tool for twisting wire around one or more articles and cutting the ends so as to form a fastener.

BACKGROUND—DESCRIPTION OF PRIOR ART

The most common tool for twisting wire around the intersection of concrete reinforcing bars is an ordinary lineman's pliers. However, this method is very labor intensive and very tiring for the operator. The repeated twisting motion of the hand and wrist necessary to form the fastener can cause muscle problems. In order to alleviate this, a method was developed which uses preformed tie wires with a loop at each end. A rotating hook is inserted into the loops after passing the tie wire around the intersection to be fastened. The hook is secured to one end of a rotating shaft fitted into a tubular sleeve. Rotation of the shaft is accomplished by a helicoidal guide ramp under the action of a pull exerted on the sleeve against the action of a return spring. This tool is commonly known as a rachet spring return twister. The cost of such individual tie wires is relatively high and various lengths have to be available to accommodate various size bundles to be fastened.

U.S. Pat. Nos. 3,091,264 to Stanford (1963), 3,593,759 to Wooge (1971), and 4,448,225 to Schmidt (1984) attempt to reduce the fatigue caused by use of lineman's pliers and eliminate the added cost of individual preformed tie wires. They combine the translation of linear motion to rotary motion afforded by the rachet spring return twister with a continuous wire supply. However, all three devices are configured such that the supply wire is passed through the axis of the rotating parts of the tool. When the wire loop forming the fastener is clamped and twisted the supply wire is also inadvertently twisted. This twisting of the supply wire is cumulative. It can cause problems in handling the wire between the tool and the supply reel. It can also result in deterioration of the strength of subsequent ties.

Both U.S. Pat. Nos. 3,091,264 and 3,593,759 have relatively complicated tying heads. Operation could be adversely effected by dirt and mud usually present at construction sites. Further, because of the configuration and fixed size of the tying heads, the tools could not be used for all fastening applications.

U.S. Pat. No. 4,448,225 has the further disadvantage in that the handle used to impart rotary motion to the twisting jaws travels back and forth on the unprotected wire between the tool and the supply source.

OBJECTS AND ADVANTAGES

Accordingly several objects and advantages of our invention are:

(a) to provide a simple, rugged tool which does not require a twisting action on the part of the operator;

(b) to form fasteners from a continuous supply spool;

(c) to form fasteners without twisting the supply wire;

(d) to form fasteners with any size perimeter;

(e) to form fasteners without exposing long lengths of wire between the supply reel and the tool to possible damage.

Further objects and advantages of our invention will become apparent from consideration of the drawings and ensuing description.

DRAWING FIGURES

Reference Numerals in Drawings

| | | | |
|---|---|---|---|
| 10 | frame | 32 | clamping and shearing jaw |
| 12 | twister | 34 | clamping and shearing jaw |
| 14 | long arm | 36 | wire |
| 16 | long arm | 38 | short arm |
| 18 | shears | 40 | short arm |
| 20 | toggle links | 42 | drag strut |
| 22 | toggle links | 44 | links |
| 24 | shears pivot | 46 | wire supply coil |
| 26 | piston | 48 | wire guide |
| 28 | cylinder | 50 | pin |
| 30 | spring | 52 | piece to be fastened |
| | | 54 | piece to be fastened |

SUMMARY OF THE INVENTION

Our tool consists of a frame holding a wire supply coil and a wire clamping and cutting shears actuated by toggle links connecting the arms of the shears to the frame. The pivot of the shears passes through one end of a piston the other end of which slides in a cylinder in the frame. The piston is biased outward by a helical compression spring in the cylinder. This tends to keep the shears jaws clamped on the wire during the twisting operation. A drag strut is connected to one arm of the shears which, when activated, opposes the biasing force of the spring. This opens the jaws of the shears allowing insertion of the wire. A commercially available rachet spring return twister is provided to convert a linear pulling motion into rotary motion, thereby twisting the wire and making the fastener. Further pulling on the twister shears the wires through the action of the toggle links.

DESCRIPTION OF INVENTION

Figure 1:
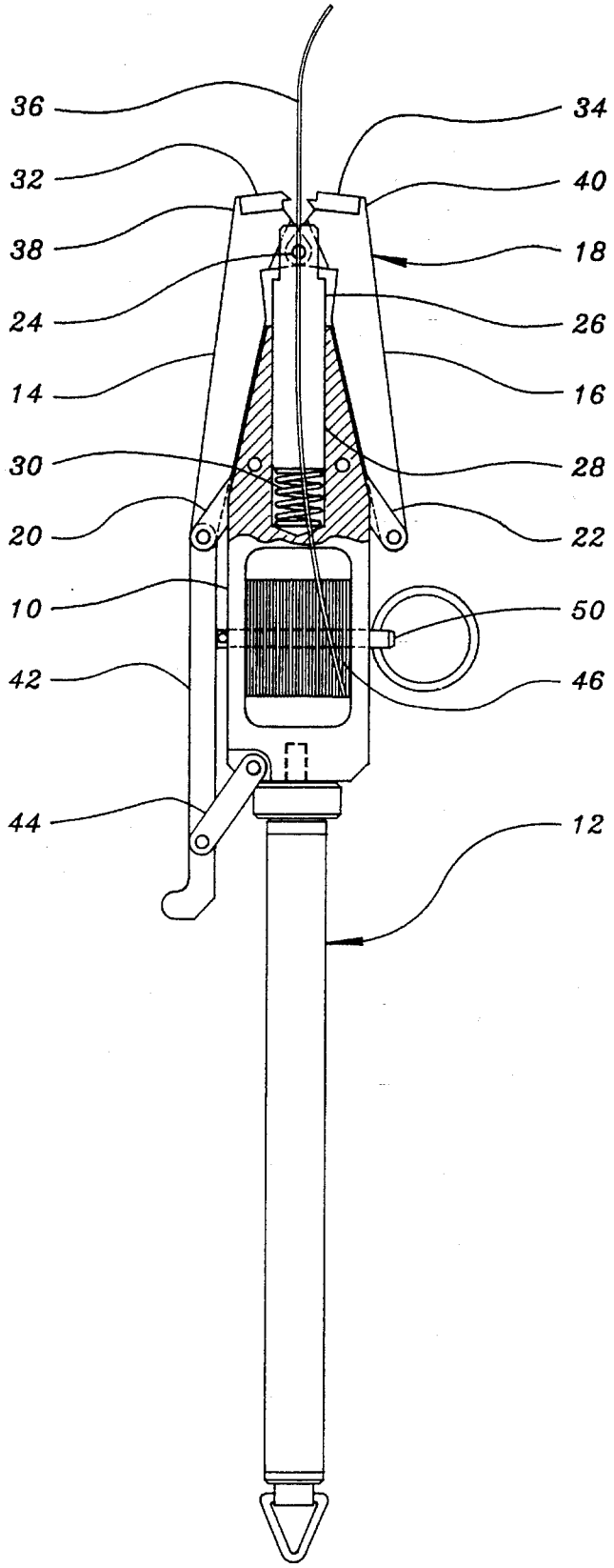
FIG. 1 is a partially sectioned view of the tool with the jaws in an open position.
Figure 2:
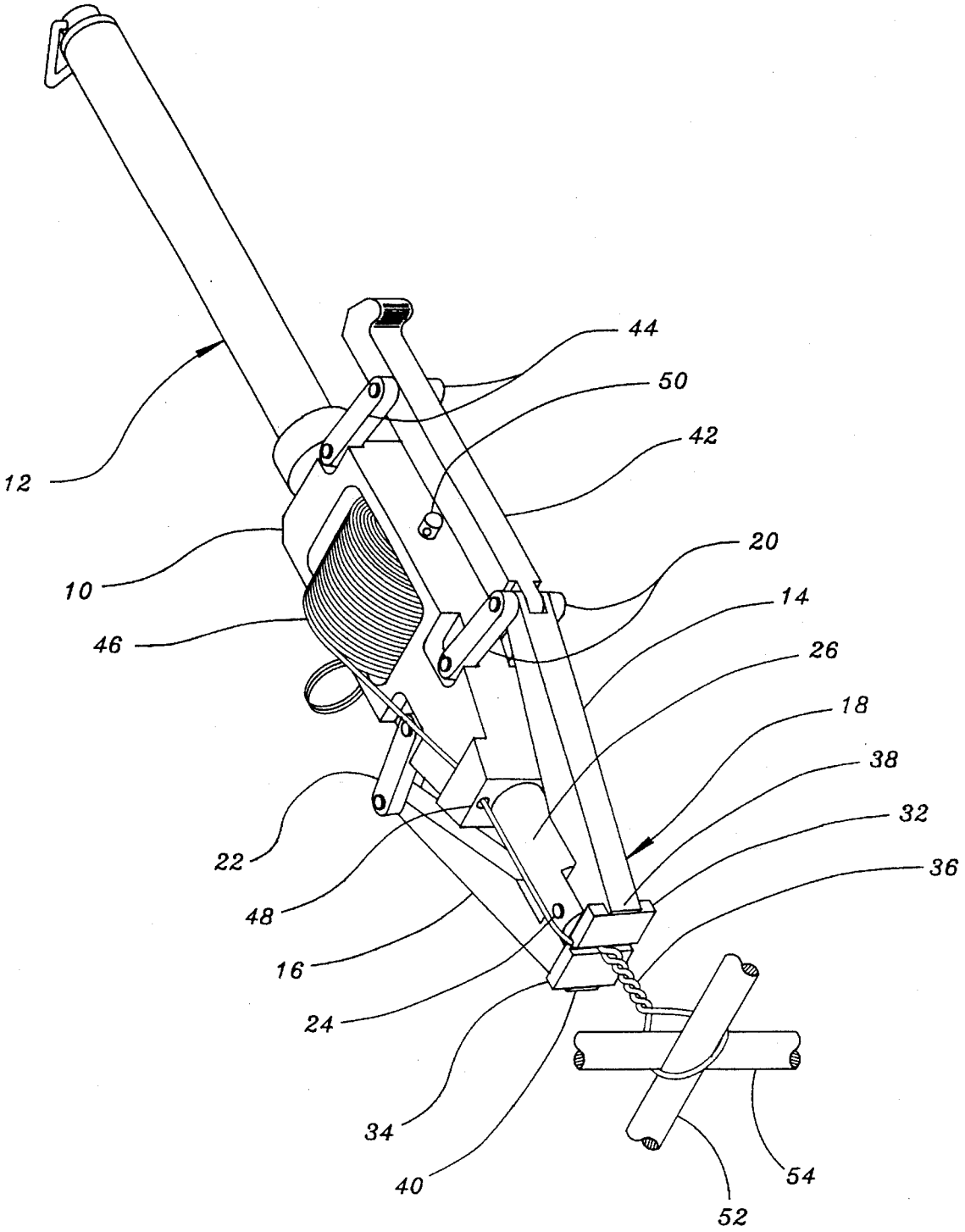
FIG. 2 shows a view as the fastener wire is twisted and cut.

Referring to FIG. 1 and FIG. 2 it can be seen that our invention consists of frame 10 fastened to the rotating shaft of a commercially available rachet spring return twister 12. Long arms 14 and 16 of shears 18 are connected to frame 10 by toggle links 20 and 22. Shears 18 is configured such that when long arms 14 and 16 are moved away from each other, short arms 38 and 40 move towards each other. Clamping and shearing jaws 32 and 34 are attached to short arms 38 and 40 respectively. Shears pivot 24 is attached to one end of piston 26. The other end of piston 26 slides in cylinder 28 in frame 10 and is biased by helical compression spring 30 which tends to force piston 26 out of cylinder 28. This biasing action maintains clamping pressure by jaws 32 and 34 on wire 36 due to the action of toggle links 20 and 22 pressing outward on long arms 14 and 16 thereby moving short arms 38 and 40 toward each other. Drag strut 42 and associated links 44 are connected to long arm 14 and frame 10. Piston 26 is prevented from exiting cylinder 28 by links 44 contacting frame 10. When a pulling force is applied to drag strut 42 away from shears 18 sufficient to overcome the biasing action of spring 30, jaws 32 and 34 open. Wire 36 is supplied from wire supply coil 46 through wire guide 48. Wire supply coil 46 is held within frame 10 by pin 50.

OPERATION OF INVENTION

By applying a force on drag strut 42 away from shears 18 the operator can open jaws 32 and 34. This allows wire 36 to be inserted between the jaws and withdrawn from wire supply coil 46. After passing wire 36 the appropriate number of times around pieces to be fastened 52 and 54, the end is placed between open jaws 32 and 34. Releasing the force from drag strut 42 closes jaws 32 and 34 clamping both the supply side and end of wire 36. Pulling on twister 12 rotates frame 10. This rotation is transmitted to shears 18 through toggle links 20 and 22 thereby twisting the wire and forming the fastener. At the completion of this process, an additional pull on twister 12 will force long arms 14 and 16 further outward through the action of toggle links 20 and 22. Jaws 32 and 34 close shearing the ends of the twisted wire fastener and separating it from the tool. Wire guide 48 is positioned so as to constrain the supply wire to the tool after the cut is made.

Wire supply coil 46 can be easily and rapidly replaced by the operator in the field through the use of pin 50 which is of the quick disconnect type.

SUMMARY, RAMIFICATIONS AND SCOPE

Accordingly, the reader will see that our invention provides a simple, rugged tool for forming twisted wire fasteners to bind together one or more pieces such as concrete reinforcing bars. It has the following advantages over prior art in that it:

- does not require twisting of the operator's wrist;
- employs a continuous wire supply coil;
- does not result in twisting of the supply wire;
- does not utilize a wire supply remote from the tool;
- is not restricted in application due to configuration;
- is inexpensive and employs commercially available rachet spring return twisters;
- is virtually unaffected by mud and dirt.

Although the description above contains many specificities, these should not be construed as limiting the scope of our invention but merely providing illustrations of some of the presently preferred embodiments of this invention. For example, it is obvious that the means to rotate the tool could be provided by electrical, hydraulic, or pneumatic devices. Further the tool could be used to close fabric or plastic bags, bind coils of wire and in numerous other fastening applications.

Thus, the scope of the invention should be determined by the appended claims and their legal equivalents rather than by the examples given.

We claim:

1. A wire twisting and cutting tool comprising a frame having two opposite ends and two opposite sides, a cylinder bored into the first end; a piston having two ends, the first inserted in said cylinder, means to provide a force to bias said piston out of said cylinder; the second end of said piston attached to the pivot pin of a shears consisting of two short and two long arms; said shears configured such that motion of said long arms away from each other results in said short arms moving towards each other; opposing clamping and shearing jaws attached to the ends of said short arms of said shears; toggle links connecting the end of one said long arm of said shears to the first side of said frame, toggle links connecting the end of the second said long arm of said shears to the second side of said frame, said toggle links tending to keep said jaws of said shears closed with a clamping force through said biasing action on said piston forcing said pivot of said shears away from said frame; a wire supply coil constrained in a cutout near the center of said frame; means to open said jaws to insert said wire; means attached to second end of said frame to provide rotation of said frame and said shears about an axis coaxial with said piston; means to apply a linear force to said frame along said rotational axis away from said shears thereby forcing said ends of said long arms of said shears further away from said sides of said frame through the action of said toggle links resulting in a cutting force on said jaws.

2. The wire twisting and cutting tool of claim 1 wherein said means to provide a biasing force on said piston is a helical compression spring located between the bottom of said cylinder and the first end of said piston.

3. The wire twisting and cutting tool of claim 1 wherein said means to open said jaws is provided by a drag strut attached to the end of one said long arm of said shears allowing a linear force to be applied in the plane of motion of said arms of said shears in a direction away from said shears.

4. The wire twisting and cutting tool of claim 1 further including a quick release pin securing said wire supply coil to said frame.

5. The wire twisting and cutting tool of claim 1 further including a supply wire guide attached adjacent to said first end of said frame.

* * * * *